United States Patent [19]

Miller

[11] 4,216,106

[45] Aug. 5, 1980

[54] CALCINED CLAY CONTAINING DIELECTRIC COATING COMPOSITION

[75] Inventor: Joseph E. Miller, Homewood, Ill.

[73] Assignee: The Sherwin-William Co., Cleveland, Ohio

[21] Appl. No.: 970,268

[22] Filed: Dec. 18, 1978

Related U.S. Application Data

[63] Continuation-in-part of Ser. No. 855,115, Nov. 26, 1977, abandoned.

[51] Int. Cl.[2] ..... H01B 3/02; B37B 9/04

[52] U.S. Cl. ..... 252/63.5; 106/30; 106/308 R; 106/308 M; 428/411

[58] Field of Search ..... 428/411; 252/63.5; 260/33.4 R, 33.6 UA; 106/30, 308 R, 308 M

[56] References Cited

U.S. PATENT DOCUMENTS

| | | | |
|---|---|---|---|
| 3,697,467 | 10/1972 | Haughney | 252/63.5 |
| 3,947,373 | 3/1976 | Sobajima et al. | 252/63.5 X |
| 3,951,882 | 4/1976 | Markhart et al. | 252/63.5 |
| 3,991,253 | 11/1976 | Markhart et al. | 252/63.5 X |

*Primary Examiner*—Thomas J. Herbert, Jr.

*Attorney, Agent, or Firm*—Richard G. Smith; James V. Tura

[57] ABSTRACT

This invention discloses that increases above about 1.75 ratio of pigment to vehicle in a dielectric coating for use in manufacture of reprographic (electrostatographic) papers unexpectedly increases the quality of the reproduction when the pigment is a calcined kaolin type clay. The inventive dielectric coating composition reduces the overall cost of static charge transfer reproductions without sacrifices in quality in the ultimate end use.

9 Claims, No Drawings

CALCINED CLAY CONTAINING DIELECTRIC COATING COMPOSITION

This application is a Continuation-in-Part of my prior application U.S. Ser. No. 855,115, filed Nov. 26, 1977, now abandoned This invention relates to the general field of reprography and in particular to improved coating compositions for the production of electrostatographic papers useful in static charge transfer reproduction processes, illustratively where the original image is latently fixed on the surface of a static charged drum face and transferred as a static charge image to the dielectric coated face of the dielectric paper. Thereafter, the image is developed through the usual toners to form a permanent, visible image.

Heretofore, dielectric paper coatings have been primarily made from dielectric resinous materials in solvent or aqueous carriers without pigmentation. However, for identifying copies the smooth transparent surface had poor acceptance of marking with ink or crayon and small amounts of pigment, e.g. of the order of 10% or less by weight of the dielectric resin were incorporated to provide tooth.

Unfortunately, the presence of pigment and particularly clay pigments as are commonly used in paper manufacture interferred with acceptance and retention of the electrostatic charge. It is also established in the prior art that the ability of the dielectric coated recording paper to accept a charge declines with increase in the pigment to binder ratio. Markhart et al, in U.S. Pat. No. 3,951,882 have disclosed a dielectric coating composition which establishes improvement in pigmented coating composition in initial voltage (charge acceptance) by use of a calcined kaolin clay first coated with organotitanium compounds. If the initial voltage or charge acceptance is greater and the charge acceptance dissipates slower, then this combination of improvements will also be measurable or be shown to exist by another recording value namely; image density of the final copy paper when in use.

It has been found in our study that the image density can actually be increased by increasing the pigment to binder solids ratio above a minimum. That minimum is preferably defined by concepts originally developed in the paint art which report greater correlation in studies of pigment and vehicle binder ratios could be obtained by working with volumes rather than weights. While it is preferred in this disclosure to work with Pigment Volume Concentrations and Critical Pigment Volume relationships, it has been found expedient and an aid to also refer to other methods of identification of these ratios so that correlation (as far as general comparisons essential to determinations for purposes of novelty are concerned) can readily be made by other than the specialist.

Successful improvements in the image density (or related charge acceptance) at high pigment loading is contrary to the present teaching in the reprographic art and has been found dependent on at least two factors (1) that the ratio by weight of pigment to non-volatile vehicle solids binder or dielectric resin must be in excess of about 1.75 to 1, or in terms of pigment volume concentration in excess of about 40%, or by a Pigment Volume Concentration to Critical Pigment Volume Concentration ratio $$\left(\frac{PVC}{CPVC} \text{ or lambda - } \lambda\right)$$

of an excess of 1.00. Each of these means of identification of a critical pigment-vehicle loading can be used in any specific, established choice of pigment and vehicle combination with equal accuracy. However, when one wishes to be most technically accurate, and the nature of the pigment and vehicle may be varied using different qualities of at least one of the variables, the PVC to CPVC or (lambda) λ value is a more accurate term when referring to combinations of pigments and vehicle dispersions of divergent component qualities.

The concept of CPVC was developed by Asbeck and VanLoo "Critical Pigment Volume Relationships", Ind. and Eng. Chem., 41, 1470 (1949) and other publications. The CPVC has been defined therein "(The) CPVC is the transition point above or below which substantial differences in the appearance and behavior of a paint film will be encountered" and later "(The CPVC is that point in a pigment-vehicle system at which just sufficient binder is present to completely fill the voids left between the pigment particles incorporated in the film after volatilization of all thinner. It represents the densest packing of the pigment particles commensurate with the degree of dispersion of the system."

Presently, the CPVC of a given pigment-vehicle binder system can be determined experimentally or it can be calculated by known computer programs if the pigment particle size distribution data and the oil absorption data are known. The calculation procedure has been summarized as follows: (A) Particle size data is corrected for an adsorbed layer based on oil adsorption data in Program ADCOR; (B) The CPVC is calculated based on the particle packing algorithum of D. I. Lee (The Packing of Spheres and Its Effect on the Viscosity of Suspensions, J. Paint Tech., 42, 579 (1970).

Suffice it to say that while the specific examples illustrating the best known methods for practice of this invention can be defined by weight ratios and volume ratios (PVC) so as to be compared with prior art, these definitive ratios for untried combinations of pigments and vehicles of qualities that are within the scope of this invention are most accurate only when defined in terms of the ratio of the PVC or Pigment Volume Concentration divided by the Critical Pigment Volume relationship.

For illustrative purposes, a series of formulas were prepared some within and others outside the scope of this invention using a calcined clay (in formulas essential to this invention) formulated with a proprietary alkyl acrylate binder (Sherwin-Williams 47-40-54) containing 46% of acrylic resin, 31% aromatic solvent, 12% aliphatic solvent amd 7.30% propanol-2, having an acid value of 21. (The calcined clay was Glomax LL of Georgia Kaolin Co.) The CPVC of the system was determined to be 37.5.

TABLE I

| Formula No. | Weight Ratio Pig./Binder | PVC/ Pigment Volume Ratio | PVC CPVC | Non-Volatile Percent | Image Density |
|---|---|---|---|---|---|
| X-71 | 2 | 44.9 | 1.198 | 45.9 | 0.88 |
| X-76 | 1.047 | 30.0 | 0.81 | 38.6 | 0.76 |
| X-79 | 1.225 | 33.4 | 0.89 | 40.2 | 0.74 |
| X-77 | 1.628 | 40.0 | 1.06 | 43.4 | 0.76 |

TABLE I-continued

| Formula No. | Weight Ratio Pig./Binder | PVC/ Pigment Volume Ratio | PVC CPVC | Non-Volatile Percent | Image Density |
|---|---|---|---|---|---|
| X-75A | 2 | 45.0 | 1.20 | 46.0 | 0.90 |
| X-78 | 2.4 | 50.0 | 1.3 | 48.5 | 0.92 |
| X-88 | 2.4 | 50.0 | 1.3 | 48.5 | 1.0 |

Several significant facts are to be noted in Table I. First, the CPVC is a constant in the system. Second, there is a fairly accurate relationship established in the fixed quality pigment and dielectric resin system with the only variation in the pigment to binder quantity so that relationships can be examined. Third, it will be noted that contrary to indications in the prior art, the image density (or charge on the paper coated with the formulas) increases consistently with increase in the pigment concentration above the observed levels as seen in Table I.

The following Table II is taken from the prior art (U.S. Pat. No. 3,951,882 Tables 4 and 5) which is of comparative interest.

TABLE II

| Dielectric Recording Medium | Initial Voltage Volts 5# Coating Weight | | | |
|---|---|---|---|---|
| Pigment:Binder (wt. ratio) | 10:90 | 30:70 | 50:50 | 70:30 |
| Untreated Clay | 440 | 120 | 40 | 20 |
| Treated Calcined Clay | 650 | 540 | 390 | 220 |
| Lithopone 40 M | 560 | 560 | 350 | 240 |
| Titanium Dioxide | 580 | 430 | 240 | 110 |
| Barium Sulfate | 480 | 350 | 130 | 60 |

These data show that the ability to accept a charge (or increase the image density which is directly related, though not essentially a linear relationship) declines with increasing pigment to binder ratios.

The present invention, in contradistinction thereto and as shown in Table I, shows that specifically with calcined kaolin clay the image density is generally increased with increase in pigment to vehicle binder solids ratios.

The importance of this discovery resides in the ability to produce electrographic papers of equal or superior quality as to image density at a lower economic cost. This follows from the fact that the pigment, calcined clay, is a less costly component than the dielectric resins essential to coatings useful in the manufacture of electrostatographic papers of this invention.

Image Density in the foregoing is determined by means of a Densitometer which measures reflectance. The higher the number, the greater the image density. In working with a representative numbe of observors it has been found that magnitudes of density so measured from about 0.03 to 0.04 points within the range of about 0.60 to about 1.40 can be regularly detected by said observors.

Two calcined clays of commerce have been found useful in the practice of this invention, Satintone #1 of Englehart Industries and Glomax LL of Georgia Kaolin Co. Other clays of similar nature may also be useful. It is understood that the preferred clay contains 83% of particles below about 2 microns, has a General Electric brightness of 85% and is freed of sintered particles after calcination at about 1100° C. for 45 minutes to leave a product containing less than 0.5% (maximum) water content. 10 to 20% of the clay product after calcination is mullite and the remaining content has no X-ray diffraction pattern. The normal (not calcined) clay is understood to be primarily kaolinitic and is sold under the tradename "Hydrite R", the calcined product being known as "Glomax LL".

In preferred practice of the invention small amounts of chlorine process $TiO_2$ or lithopone are included as a very minor part of the pigment content to enhance brightness of the coating. Brightest coatings were obtained with $TiO_2$ (Tidox 900).

While it is not our intent to be bound by theory, it is believed in the calcined clay essential to this invention the individual particles tend to act as micro-capacitors. It is suggested that without the high temperature calcination the clay particles contain sufficient moisture content to destroy their capacitance function. The coatings of this invention are not as outstanding in direct electrographic copy use. It is suggested that in these systems there is sufficient charge to overwhelm the capacitor effect theorized above.

The prior art has not seemed to observe, distinguish or recognize differences noted here between the direct (pulse) printing papers and those to which this invention is primarily directed.

The coatings of this invention have shown superior qualities particularly where a corona charge mechanism is involved.

Base paper stocks useful and commercially available upon which the invention was reduced to practice include St. Regis PTR-2079, St. Regis MF, KC 9518 and Weyerhauser DX grade.

Coating weights most popularly used in the field are of the order of 5 to 6 pounds per book ream (3300 sq. ft.). If the weight of inventive coating is increased above this quantity performance is increased, but at obviously higher cost. At least one side of the paper is coated with electroconductive coatings as is well understood in the art. These coatings embrace quaternary resins, salts, and combinations thereof.

Dielectric coatings resins useful for the purpose of the coating compositions of this invention are not particularly critical. Some are better than others, however. Those found particularly qualified and representative of the best selections known for reducing the invention to practice include polyvinyl acetate polymers, copolymers of various alkyl acrylates alone and in combination with minor amounts of other copolymerizable monomers including acrylic acid, methacrylic acid, styrene, etc. It has also been found that the fatty acid modified alkyds (polyhydric alcohol-polycarboxylic acid-monocarboxylic acid modified esters, sometimes identified as oil-modified alkyd resins in paint technology, also provide a useful class of dielectric resins in the formulations of the dielecric coating compositions of this invention. Also useful generally are poly(vinyl formals) and poly(vinyl butyrals) and interpolymers of styrene and substituted styrenes with alkyl acrylates or alkyl methacrylates. The poly(vinyl butyral) resins are characterized by a vinyl acetate content of less than 10 percent by weight, a "vinyl alcohol" content of from 9 to 21 percent by weight and a weight average molecular weight in the range of 20,000 to 500,000. Particularly preferred poly(vinyl butyrals) have a "vinyl alcohol" content of from 9 to 13 percent. The interpolymers of styrene or a substituted styrene containing 9 to 13 carbon atoms and an acrylic or methacrylic ester of a $C_1$ to $C_8$ saturated monohydric aliphatic alcohol comprise from 30 to 70 parts by weight of a styrene or substituted styrene and 30 to 70 parts by weight of acrylic or methacrylic ester and optionally up to 10 parts by weight of an acid comonomer such as acrylic acid, methacrylic acid, crotonic acid or maleic acid, the relative viscosity of the interpolymer being in the range of 1.1 to 3.0 when measured as a 2 percent solution in benzene.

Thirty five different dielectric resins, 27 of which were products of The Sherwin-Williams Company and 8 of which were from commercial suppliers of resins for electrostatographic coatings were used in the development of the invention without failure.

Experience has indicated that use of the highest amount of volatile aromatic solvent and the least practical amount of water soluble solvents as the volatile component of the dielectric resin solution is preferable. Some anomolous results appearing in our research appear to be due to the use of sufficient quantities of ethyl alcohol to solvate some species of useful binders. For example, polyvinyl butyral resins containing lower alkyl alcohols (less than 3 carbon atoms) tend to soften and dissolve the conductive resins first applied to the base paper stock to impart conductivity. Migration of the alcohol solvated conductive resin into the dielectric coating of the copy paper appears to occur and impairs the results obtained with the herein described and claimed pigmented coatings.

The best method known to practice the invention is illustrated in the following Examples.

EXAMPLE I (Preparation of Vinyl Acetate Copolymer)

308 parts by weight of vinyl acetate monomer, 80 parts isobutyl acrylate monomer, 6 parts glacial methacrylic acid, 92 parts 2-methyl propanol and 40 parts toluene are heated in a closed reactor (fitted with a distillate return condenser, thermometer and agitator) and interpolymerized with the aid of periodic addition of a catalyst solution comprising azo bis isobutyronitrile in an alcohol-toluol solution in small increments over about a ten hour heating cycle at about 165° to 175° F. to produce a dielectric resin copolymer solution having about 47.50% vinyl polymer, 26% butyl alcohol and about 26% aromatic solvent and an acid value of 12.

This dielectric resin or copolymer was found suitable as a standard vehicle in mixing a variety of dielectric coating compositions for the tests scheduled.

EXAMPLE II 289.1 parts toluene and 20 parts of propanol-2 were weighed into an agitator equipped vessel equipped with a Cowles high speed agitator followed by 222.14 parts of a vinyl acetate copolymer of Example I.

After dilution and agitation, 406 parts of a calcined kaolin clay (Glomax LL) and 21 parts of Rutile $TiO_2$ (chloride process, emulsion type) are mixed in a high speed Cowles for about 15 minutes. Lower degrees (poorer) dispersions of the pigment in the vehicle appear to contribute to a slight decrease in image density. After about fifteen minutes running time the batch is drained from the vessel and the residue therein washed out with about 70 parts toluene. The product has a 4.5 Hegman gauge grind and the following general compositions analysis 2.0% $TiO_2$ (Type III); 39.5% silicates, 10.27% vinyl polymer, 7.5% volatile alcohol and 40.55% aromatic (toluene) solvent. Weight/gallon 10.27. Pigment Volume Concentration 62.3. The ratio of the PVC to the CPVC is greater than 1.

The resulting coating composition is coated on an electroconductive paper at about 5 to 7 lbs. per book ream of 3300 square feet.

The paper was used on a Minolta copier (based on the indirect dielectric method of producing a positive image) which involves a charge transfer technique. The image density was of the order of 0.90 as measured with a Densiometer.

EXAMPLE III

Repeat of Example II in detail with the exception of use of a dielectric vehicle identified by The Sherwin-Williams Company as 47-40-54 which has 46% acrylic copolymer resin solids consisting essentially of butyl, methyl and lauryl methacrylate monomers interpolymerized with a small amount of glacial acrylic acid in a solvent consisting of about 3.7% ketones, 7.3% lower alkyl alcohol, 31% aromatic solvent (toluene) and 12% aliphatic solvent, the resin copolymer having an acid value of 21.

EXAMPLE IV

A series of dielectric coating compositions similar to the above were produced wherein the dielectric resin of Example III was formulated with calcined clay (Glomax LL) at a series of pigment to vehicle binder solids ratios. This series of coatings were identified as X-71, X-76, X-79, X-77, X-75A, X-78 and X-88, all as has been previously set out in Table I.

These coatings were applied to standardly treated conductive coated base paper stock all at a standard weight per book ream.

Analysis of the data assembled and as set out in Table I clearly shows that as one increases the volume of pigment to volume of dielectric resin the image density is increased by visibly material increases particularly when the pigment volume ratio is above about 40 or the PVC to CPVC ratio (lambda $\lambda$) is above 1. Image densities of 1.0 have been obtained at these higher pigment to vehicle solids ratios as shown in X-88, Example of Table I.

EXAMPLE V

It has been heretofor indicated that small amounts of $TiO_2$ useful to provide hiding can be combined with the calcined kaolin clay without adversely effecting the image density. Investigation of use of other commonly used pigments as partial substitutes for the calcined clay generally have yielded adverse results. It has been found however that calcium carbonate pigment can be used in partial substitution for the clay, but settling problems increase as the levels of substitution are increased. It has been also noted that total substitution of calcium carbonate for the particular clay leads to objectionable settling and at PVC to CPVC levels above about 1.6 the rheology of the system seriously interferes with satisfactory storage and application qualities.

The following formulation variation series as set out in Table III were calculated at a PVC/CPVC of 1.1 and explores the above combination pigments at various substitution levels. These examples were made using the polyvinyl acetate polymer systems of Example I. (Example DX 328 from the table has been selected for specific manufacturing detail). All parts are by weight.

DX 328 was made by blending together 23.5 parts of toluene, 1.3 parts isobutyl alcohol, 30.2 parts polyvinyl acetate polymer, 22.2 parts calcined clay and 7.4 parts calcium carbonate pigment. The foregoing components were subjected to high shear in a high speed blender-impeller to at 4.5 Hegman gauge grind. 15.4 parts toluene were used to adjust the viscosity for application.

TABLE III

| Experimental Identification | Weight Ratio Clay/Carbonate | Print Density | *Settling Character |
|---|---|---|---|
| DX 326 | 100/0 | 0.95 | Best |
| 328 | 75/25 | 1.01 | Good |
| 329 | 50/50 | 0.95 | Good |
| 330 | 25/75 | 1.05 | Good |
| 331 | 0/100 | 1.02 | Objectionable |

*Observed after one week at rest.

Economy in formulation with partial replacement of the calcined clay with calcium carbonate may prove advantageous.

I claim:

1. An improved coating composition for the production of reproductive papers and papers useful in static charge transfer reproduction processes characterized by improved image density qualities which coating comprises a fluid dispersion of a controlled quantity of pigment, the essential clay pigment of which is kaolin clay calcined to an organic free state prior to its dispersion into a dielectric resin, a dielectric resin, and a volatile organic solvent for said resin, said total quantity of pigment weight to the said resin solids weight being greater than a ratio of about 1.75/1.

2. The coating composition of claim 1 wherein the weight ratio of pigment to resin solids is from about 2:1 to not more than about 7:1.

3. The coating composition of claim 1 wherein the volatile organic solvent contains not less than about 50% by weight aromatic solvent and not more than about 20% by weight of a lower alkyl alcohol having not more than 2 carbon atoms in the alkyl group.

4. The composition of claim 1 wherein the ratio of the Pigment Volume Concentration PVC to the Critical Pigment Volume Concentration CPVC of the system of calcined clay and dielectric resin solids is from one to not more than two.

5. The coating composition of claim 1 wherein the dielectric resin is a vinyl monomer modified alkyl acrylate resin and the solvent comprises a major amount of a volatile aromatic liquid and a minor amount of lower volatile alcohol.

6. The coating composition of claim 1 wherein the dielectric resin is a polyvinyl acetate copolymer.

7. The coating compositon of claim 1 wherein the dielectric resin comprises a polyhydric alcohol-polycarboxylic acid-fatty acid condensate resin.

8. The product of claim 1 where the dielectric resin is an oil modified alkyd resin.

9. The composition of claim 1 wherein the principal pigment content consists of a calcined kaolin clay and calcium carbonate; the total calcium carbonate pigment content not exceeding about 75% by weight of the total pigment content and the ratio of the Pigment Volume Concentration or PVC to the Critical Pigment Volume Concentration or CPVC, or lambda, is from one to not more than about 1.6.

* * * * *